US007060489B2

(12) United States Patent
Tanaka et al.

(10) Patent No.: US 7,060,489 B2
(45) Date of Patent: Jun. 13, 2006

(54) PROTEIN CHIP HOLDING TOOL

(75) Inventors: Kouji Tanaka, Nagoya (JP); Yasuhiro Fukao, Nagoya (JP)

(73) Assignee: Moritex Corporation, Tokyo (JP)

( * ) Notice: Subject to any disclaimer, the term of this patent is extended or adjusted under 35 U.S.C. 154(b) by 475 days.

(21) Appl. No.: 10/081,580

(22) Filed: Feb. 22, 2002

(65) Prior Publication Data

US 2003/0099579 A1 May 29, 2003

(30) Foreign Application Priority Data

Nov. 26, 2001 (JP) ..... 2001-358678

(51) Int. Cl.
*B01L 9/00* (2006.01)

(52) U.S. Cl. ..... 435/288.4; 422/52; 422/99; 422/100; 422/104; 435/305.1; 435/283.1; 436/180; 220/523; 206/730; 206/139

(58) Field of Classification Search ..... 422/99–104, 422/52; 435/286.4, 288.4, 305.1; 436/180; 220/523; 206/730, 139
See application file for complete search history.

(56) References Cited

U.S. PATENT DOCUMENTS 5,100,626 A * 3/1992 Levin ..... 422/100
5,133,939 A * 7/1992 Mahe ..... 422/104
5,989,402 A * 11/1999 Chow et al. ..... 204/601
6,232,861 B1 * 5/2001 Asada ..... 335/222

* cited by examiner

*Primary Examiner*—Jill Warden
*Assistant Examiner*—Jyoti Nagpaul
(74) *Attorney, Agent, or Firm*—Frishauf, Holtz, Goodman & Chick, P.C.

(57) ABSTRACT

The present invention is object to provide a protein chip holding tool that is capable of effectively executing analysis work by preventing protein from being denatured and/or inactivated due to drying while attempting to make the amount of spotting of protein test samples to be spotted on a substrate very slight, and said a chip holding tool comprising a substrate holding member 39 in which at least one or more substrate holding portions 41 holding the substrate 35, a resilient holding member 45 that covers the upper surface of the substrate holding member 39, a resilient body engaging portion 51 holding the resilient body 37, and an opening and closing member 53 that is movably supported on the upper surface of the resilient holding member 45 and opens and closes the openings 45*a*.

5 Claims, 11 Drawing Sheets

PROTEIN CHIP HOLDING TOOL

FIELD OF THE INVENTION

The present invention relates to a protein chip holding tool that is used to produce protein chips by spotting a number of protein test sample solutions on a substrate and to carry out various types of analyses such as solidifying reaction, detection reaction, etc., by distributing a preparation to be tested, on the respective protein test sample solutions of the produced protein chips.

BACKGROUND OF THE INVENTION

For example, when carrying out various types of protein analyses such as protein screening, quantitative analysis, etc., like a blood test in clinical fields, a protein test sample solution is distributed into respective holes of a microtiter plate (80 mm wide×120 mm long, 96 holes or 384 holes), and protein chips are prepared. After that, a solution of a preparation to be tested is distributed into the respective holes of the protein chips, whereby the preparation to be tested is analyzed by a solidification reaction and a detection reaction.

Recently, in order to efficiently analyze a number of test samples to be tested in analysis work at a time and to reduce the number of consuming test samples in protein analysis and oligonucleotide (DNA, RNA) analysis, a great number of test samples are spotted on a single substrate at a high density. Resultantly, test samples to be spotted are made very slight in order of microliter or nanoliter per spot.

However, as regards protein test samples, where the spotting amount is made very slight as described above, the protein test samples are dried in a very short time, and the protein itself is denatured and is inactivated, wherein there is a problem in that the analysis work is disabled. Therefore, it is necessary to increase the number of spots while preventing the protein from being denatured and/or inactivated due to drying when producing protein chips.

The present invention has been developed so as to solve the problems in the prior arts, and it is therefore an object of the invention to provide a protein chip holding tool that is capable of effectively executing analysis work by preventing protein from being denatured and/or inactivated due to drying while attempting to make the amount of spotting of protein test samples to be spotted on a substrate very slight as described above.

DETAILED DESCRIPTION

Figure 1:
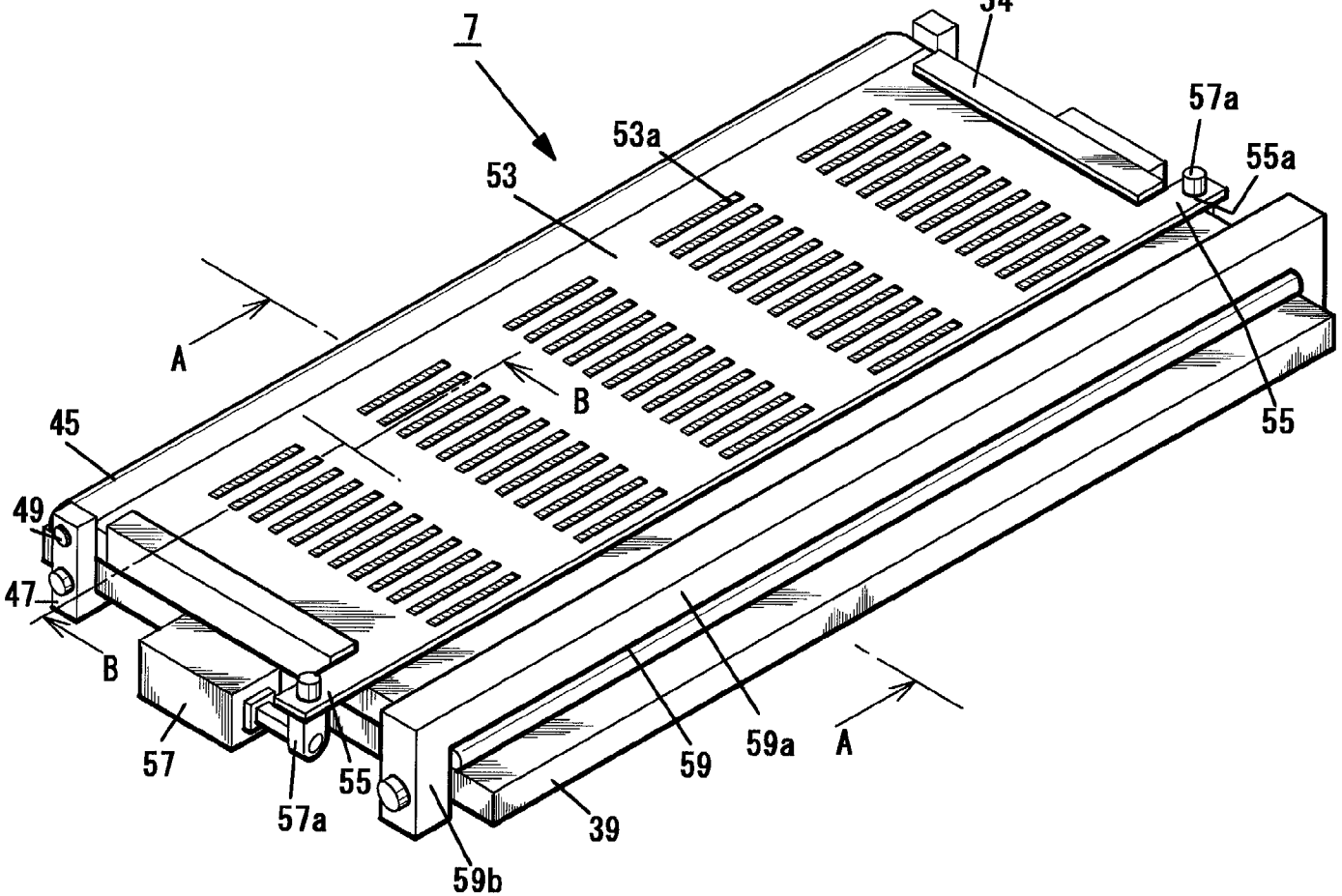
FIG. 1 is an entire perspective view of a protein chip holding tool.
Figure 2:
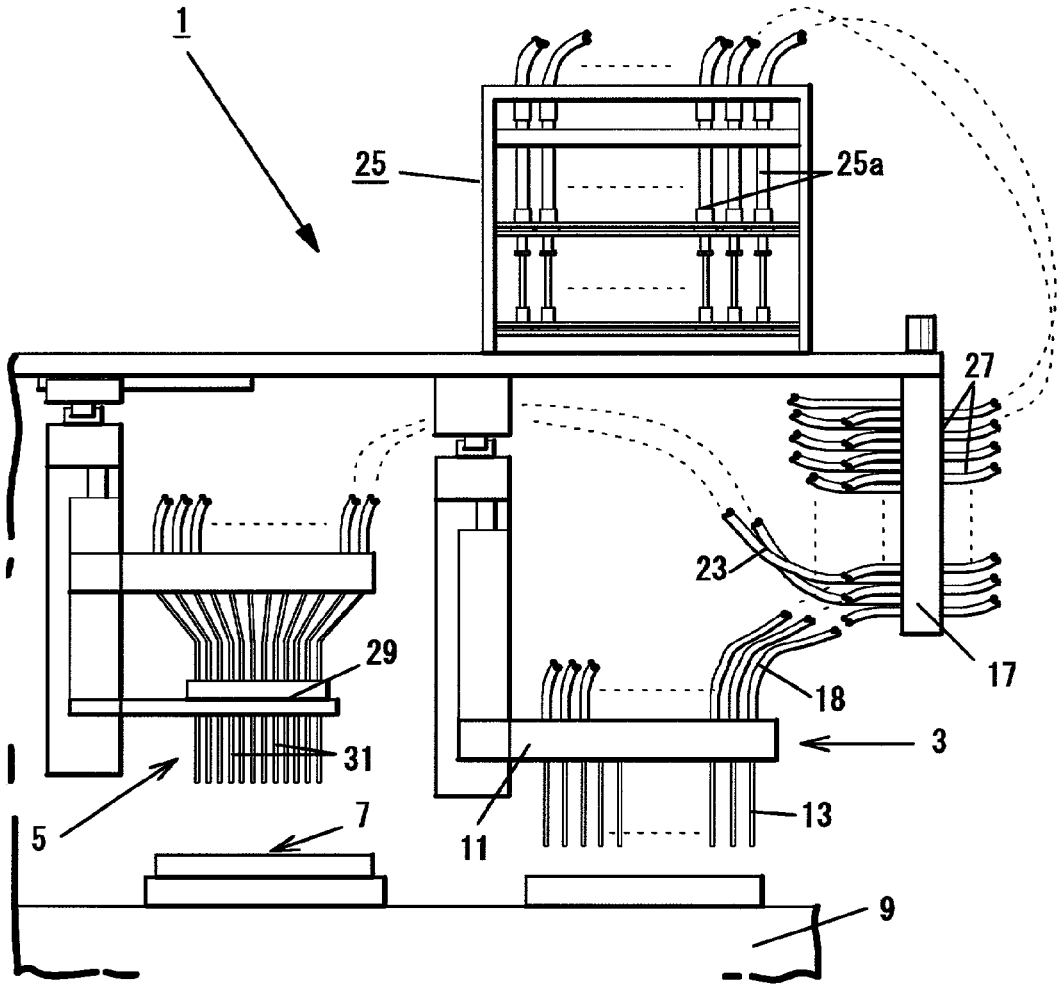
FIG. 2 is an entire front elevational view of a unit for spotting a protein test sample solution.

Hereinafter, a description is given of embodiments of the invention with reference to the accompanying drawings.

In FIG. 1 through FIG. 7, a unit 1 for spotting a protein test sample solution is composed of the suction and discharge unit 3 and a distributing unit 5, and a protein chip holding tool 7 according to the invention is fixedly or detachably attached to distribution points of the distributing unit 5.

First, a description is given of the unit 1 for spotting a protein test sample solution that is used to produce protein chips and to react the same with preparations to be tested.

The suction and discharge unit 3 is disposed on the illustrated right side of the body frame 9 of the unit 1 for spotting a protein test sample solution, and a moving body 11 of the suction and discharge unit 3 is caused to reciprocate in the three-dimensional directions by an X-axis drive mechanism, a Y-axis drive mechanism and a Z-axis drive mechanism (neither of these illustrated).

The above-described drive mechanisms of respective axes can be composed of a feed-screw drive mechanism that is constructed of a feed screw coupled to a servo motor and a nut secured on a moving body on the respective axes, a belt drive mechanism in which a part of a belt applied to a pair of rotary bodies, one of which is coupled to a servo motor, is fixed on a moving body on the respective axes, or a linear motor in which a servo motor is composed of a stator and a mover secured on the moving body.

A number of suction needles 13 each having an axial line in the up and down direction, are disposed to be in a matrix form of, for example, 8×12 at appointed spacing in both the X-axis and Y-axis directions. The respective suction needles 13 are faced to respective reservoirs (neither of these illustrated) of a container body placed on the body frame 9. The same type or different types of protein test sample solutions, which are spotted on a substrate 35 of a protein chip 33, described later, which is about to be produced, and solutions of preparations to be tested, which are caused to be reacted with the protein test samples to be spotted on the protein chips 33 are accommodated in the respective reservoirs of the corresponding container body.

The base end portions of the respective suction needles 13 are connected to a suction and discharge changer device 17 via a pipe 18. The suction and discharge changer device 17 is composed of a fixing board (not illustrated) in which a plurality of suction portions and discharge portions that are coincident with the number of suction needles 13 are provided adjacent to each other, and a changer board (not illustrated), which is provided with a suction and discharge portion that is supported so as to move over a distance equivalent to an arrangement interval of the suction portion and discharge portion in an airtight state with respect to the corresponding fixing board, and that selectively communicates with the respective suction portions and discharge portions.

And, the end portion of the pipe 18 connected to the suction needle 13 is connected to the suction portion of the fixing board. Also, the end portion of a pipe 23, which is connected to the distribution device 5 described later, is connected to the discharge portion. Also, the end portion of a pipe 27 that is connected to a suction and discharge device 25 is connected to the suction and discharge portion of the changer board.

The suction and discharge device 25 is composed of syringes 25*a* whose quantity is equivalent to, for example, the number of suction needles 13, a protein test sample solution and a preparation solution to be tested, which are reserved in respective reservoirs, are sucked into syringes 25*a* in line with reciprocation of a piston, and at the same time the sucked protein test sample solution and preparation solution are discharged to a distribution device 5. The amount of suction of the protein test sample solution and preparation solution and the amount of discharge thereof are adequately established by a stroke movement of the piston. The stroke of the piston may be established so that the amount of discharge of the protein test sample solution and preparation solution with the distribution device 5 are caused to become, for example, 0.5 through 10 μl, preferably 5 μl.

Further, the protein test sample solution and preparation solution to be tested is made into a solution in which protein and a preparation to be tested, which reacts therewith, are dissolved in, for example, PBS (0.14M sodium chloride, and 0.01M phosphate buffer solution, whose pH has been adjusted to 7.2).

The distribution device 5 is disposed at the left side of the illustrated body frame 9. A moving body 29 of the corresponding distribution device 5 is controlled so as to move in three-dimensional directions by drive mechanisms (all of which are not illustrated) similar to the X-axis, Y-axis and Z-axis drive mechanisms of the suction and discharge device 3.

The underside of the moving body 29 has an axial line in the up and down direction, and is provided with a number of distribution needles 31, which are disposed in 8-by-12 matrices with spacing of approx. 100 through 1000 μm in, for example, the X-axis and Y-axis directions. The respective distribution needles 31 have a diameter of 500 through 2000 μm at their tip end sides, and pipes 23 are connected to the respective base end portions.

The tip end parts of the respective distribution needles 31 are selectively faced to a number of protein chips 33 that are set in a protein chip holding tool 7 secured at the distribution device 5.

The respective protein chips 33 have a structure in which a silicone rubber made resilient layer 37 is laminated on a substrate 35 such as slide glass, a plastic plate, etc., made of polyethylene, polypropylene, etc. Holes 37*a*, whose number is coincident with the number of distribution needles 31, having the same matrices (8-by-12 matrices) as those of the distribution needles 31 are formed on the resilient layer 37, and the plane facing the substrate 35 is ground and flattened, thereby securing satisfactory contacting ability with the substrate 35.

Next, a description is given of the protein chip holding tool 7.

Figure 9:
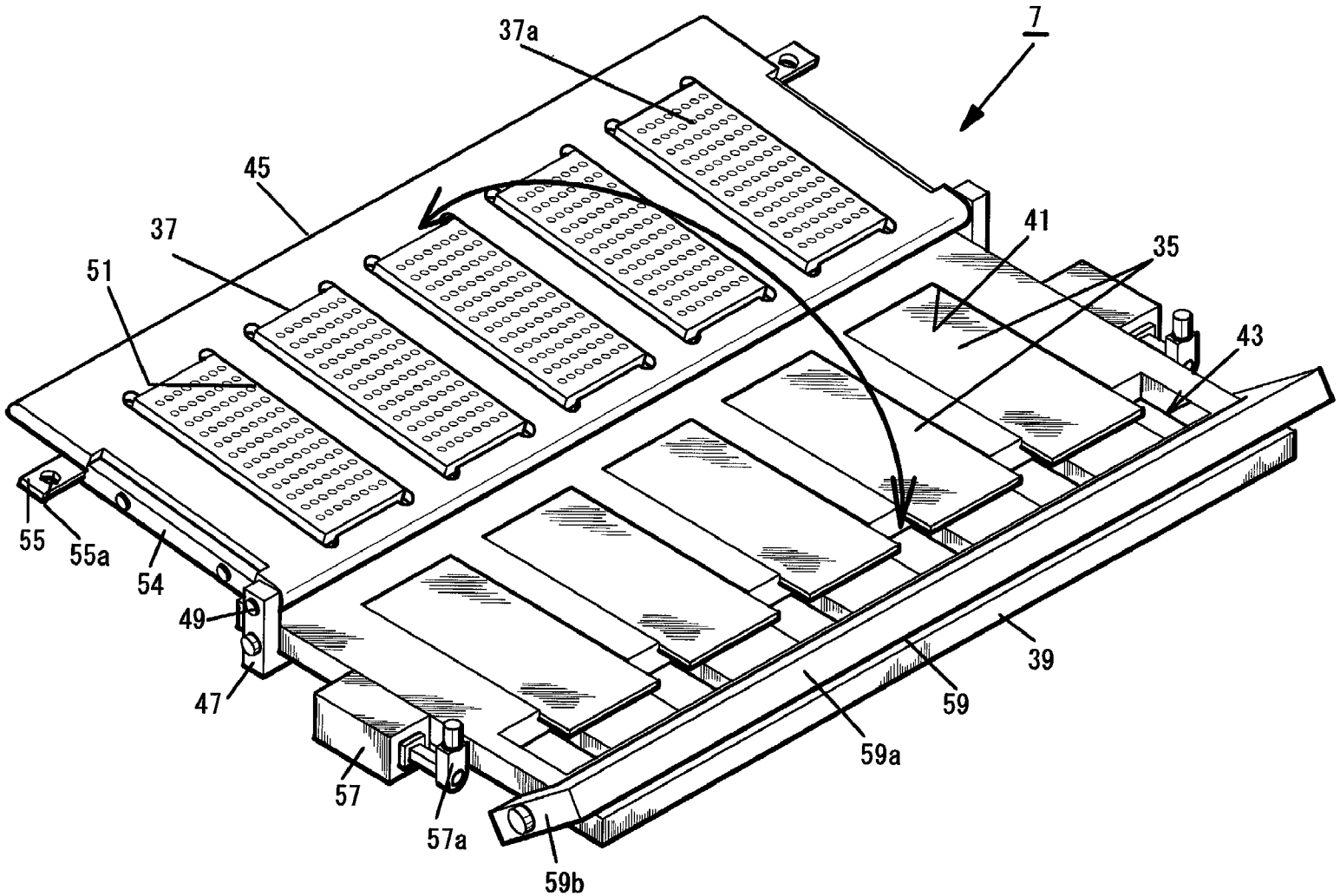
FIG. 9 is a view showing a state where a substrate and a resilient layer are set on the protein chip holding tool.

A base plate 39 holds five substrates 35, for example, as shown in FIG. 9. On the upper plane of the base plate 39, downward facing recesses 41 which are shaped so as to be coincident with the respective substrates 35 are provided with adequate spacing in the lengthwise direction of the base plate 39, and the substrates 35 are held in the respective downward facing recesses 41.

Notched parts 43 are formed in the base plate 39 such that a finger, for example, may be inserted into the respective notched parts 43, thereby enabling removal of the substrates 35 held in the downward facing recesses 41.

Figure 3:
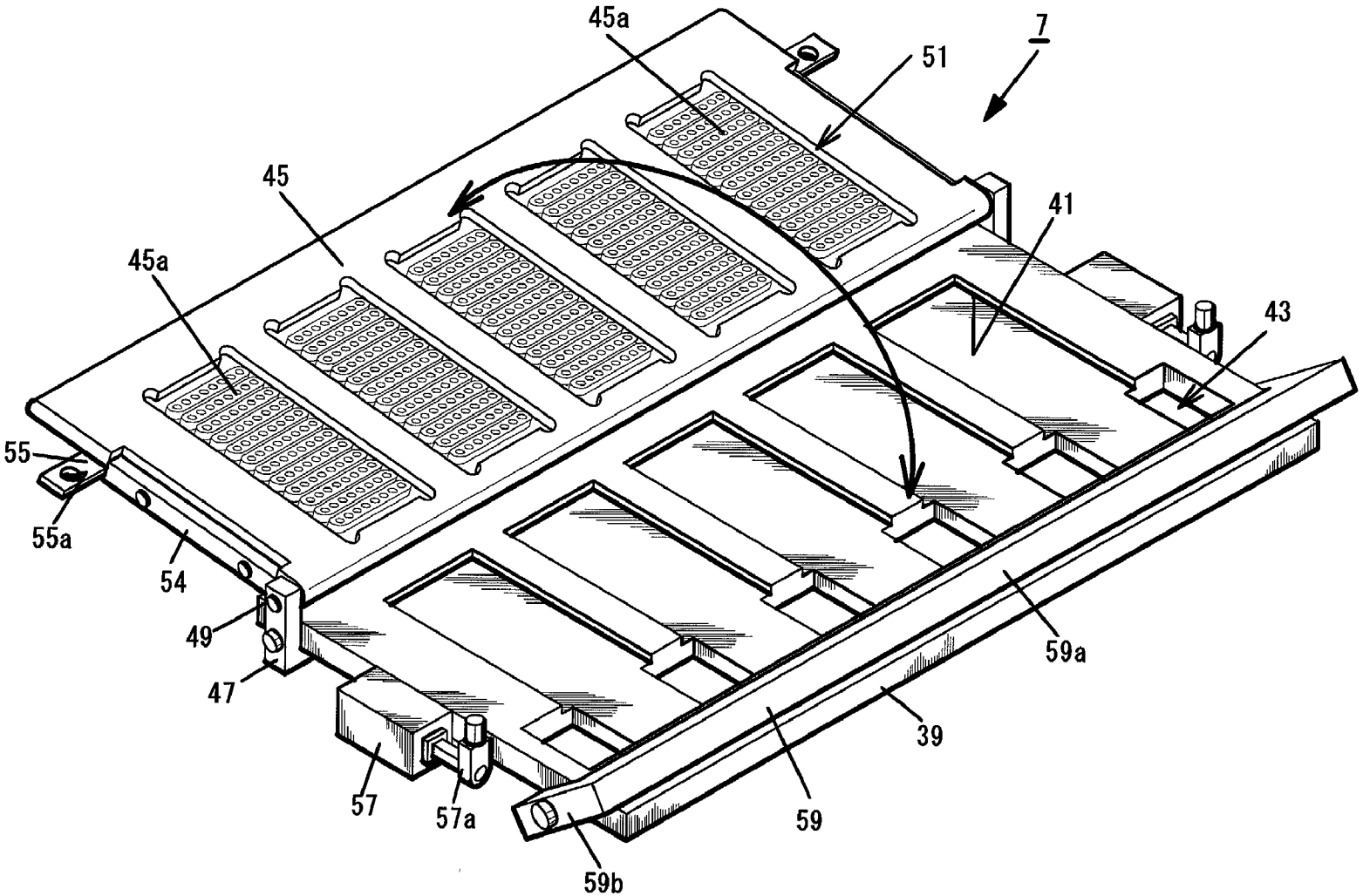
FIG. 3 is a perspective view showing a state where a resilient layer retaining member of the protein chip holding tool is released.

A lid 45 that constitutes a resilient layer holding member is supported at the left side end part, of the base plate 39 as shown in FIGS. 3 and 9 so that the lid 45 moves and turns between the position covering the upper surface of the base plate 39 and the position separated therefrom.

Upward facing recesses 51 that are sized to be coincident with the downward facing recesses 41 are formed on the bottom (the plane facing the base plate 39) of the lid 45 so that these recesses 51 are faced to the respective downward facing recesses 41. And the resilient layers 37 that constitute parts of the protein chips 33 are held in the upward facing recesses 51.

A number of holes 45*a* that function as openings are provided in the lid 45, in areas corresponding to the upward facing recesses 51, so as to be coincident with the respective holes 37*a* in the resilient layers 37 that are retained in the respective upward facing recesses 51.

Figure 4:
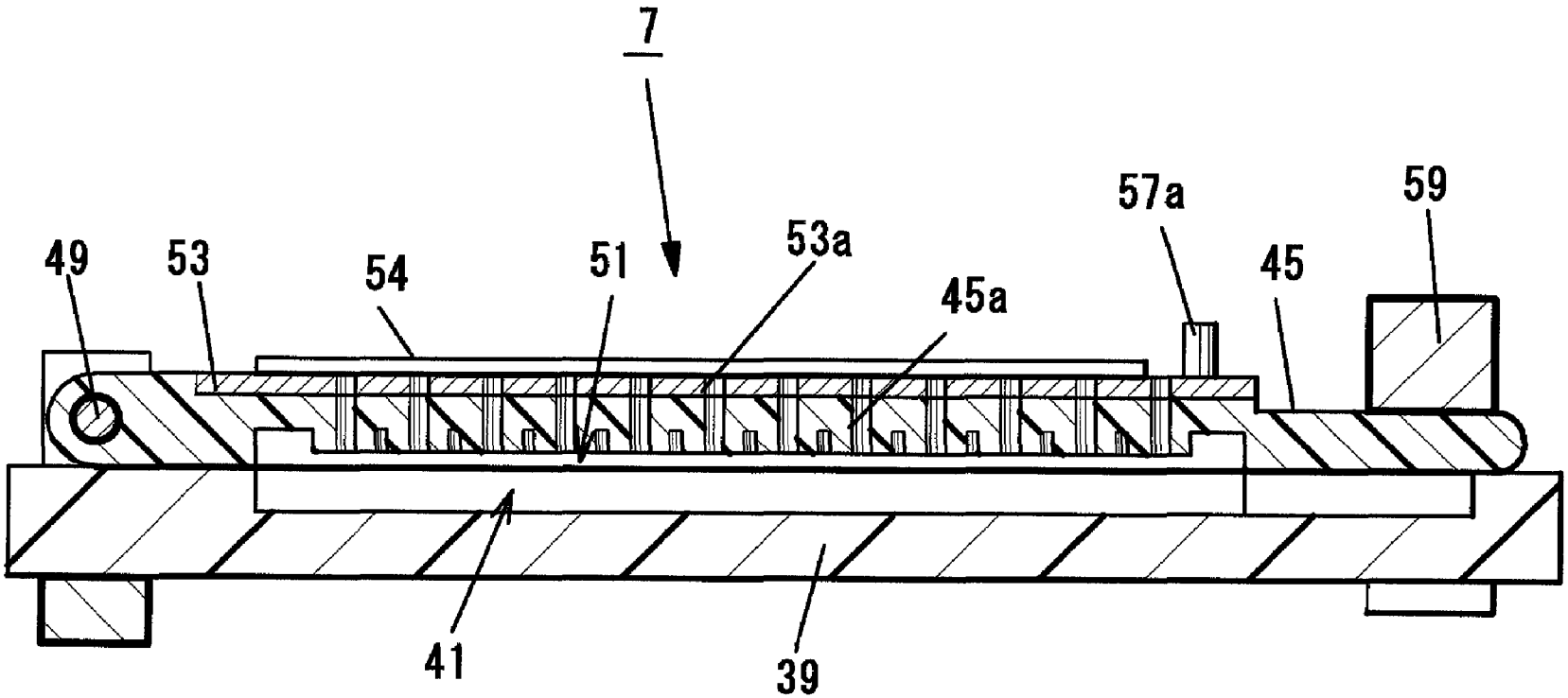
FIG. 4 is a longitudinally sectional view taken along the line A—A in FIG. 1.
Figure 5:
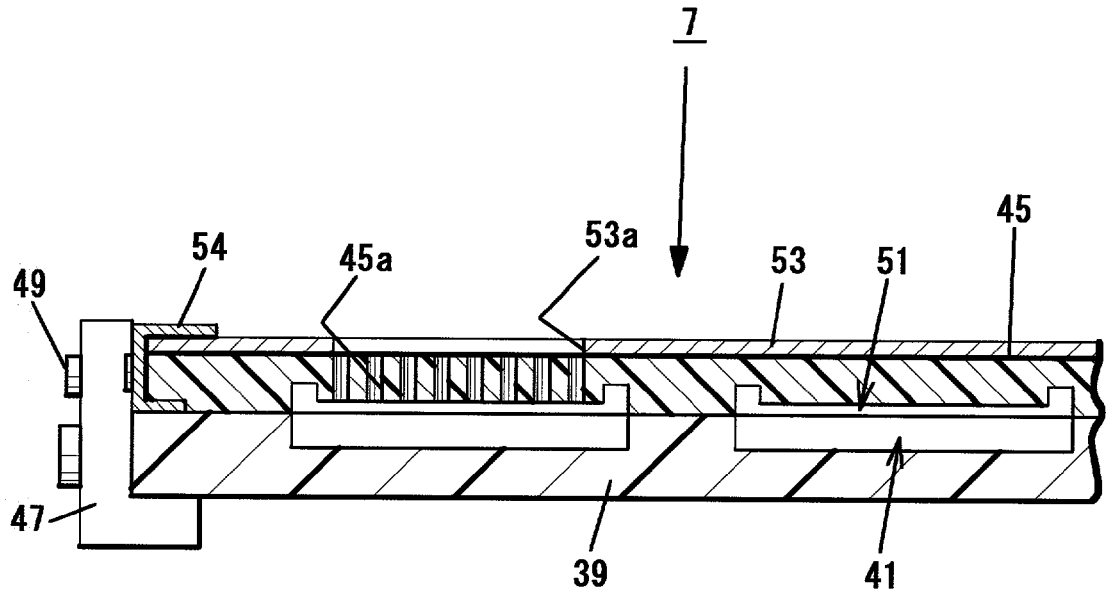
FIG. 5 is a longitudinally sectional view taken along the line B—B in FIG. 1.

A slide shutter 53 is supported on the upper surface of the lid 45 so as to be movable in the left and right direction shown in the FIG. 4 over approximately half of the distance between the holes 45*a* in the left and right direction of FIG. 4. A number of slits 53*a* are formed in the slide shutter 53 so as to become coincident with the respective holes 45*a* when the slits 53*a* are moved to the left side, as shown in FIG. 4, on the lid 45. The slide shutter 53 locates the respective slits 53*a* between the respective holes 45*a* to close the holes when the slide shutter 53 is moved to the right side with respect to the lid 45. The slide shutter 53 exposes the respective boles 37*a* of the resilient layers 37 to the outside via the slits 53*a* and respective holes 45*a* when the slits 53*a* are positioned over the holes 45*a*.

Figure 6:
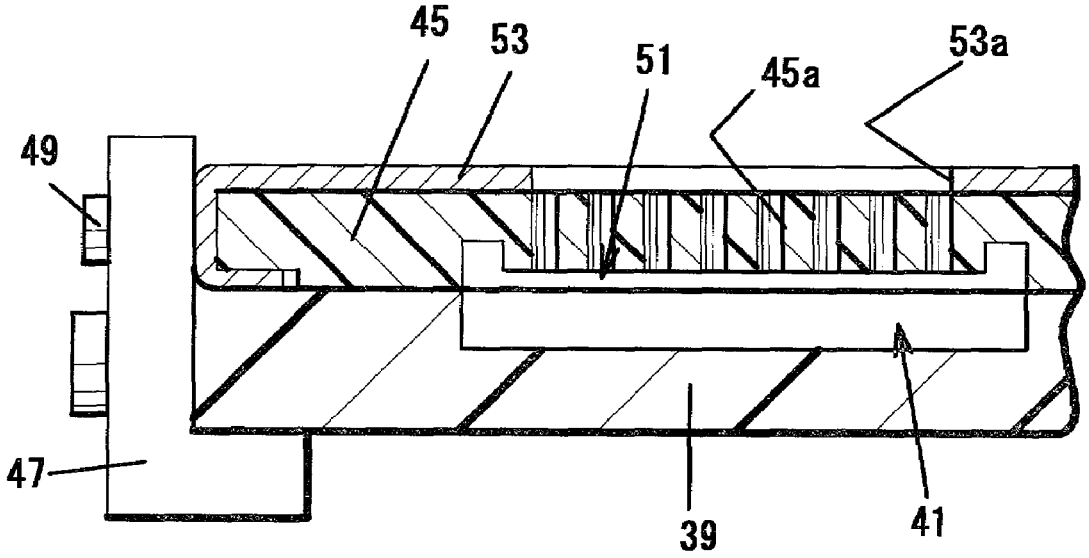
FIG. 6 is a view explaining another example of a supporting structure of a slide shutter.
Figure 7:
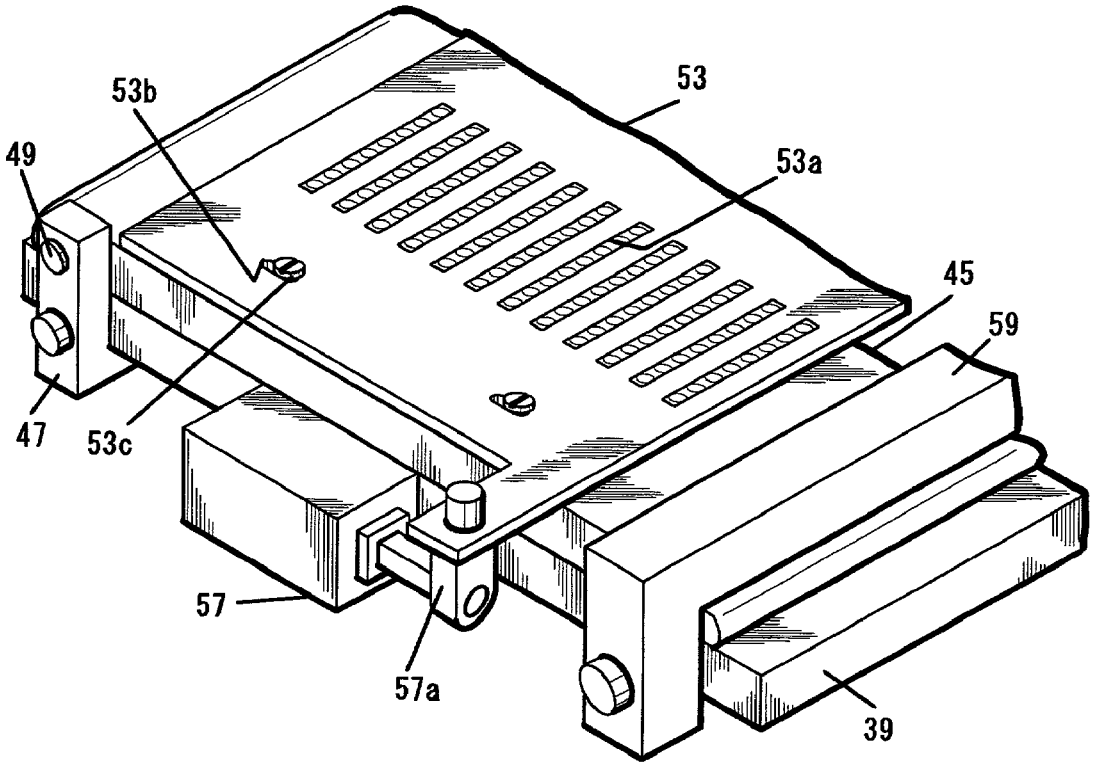
FIG. 7 is a view explaining still another example of the supporting structure of the slide shutter.

The structure for supporting the slide shutter 53 with respect to the lid 45 may be a structure for slidably supporting the end part of the slide shutter 53 on a supporting plate 54 secured at both ends of the lid 45 in the lengthwise direction thereof as shown in FIG. 1. Alternatively, the respective end portions of the slide shutter 53 in the lengthwise direction may be folded to be like an inverted C shape with regard to the cross section thereof and the end portions may be slidably engaged with the respective end portions of the lid 45 and support the same as shown in FIG. 6. Alternatively, slits 53 *b* having a length coincident with the moving amount of the slide shutter 53 may be formed on the respective end portions of the slide shutter 53 in the lengthwise direction as shown in FIG. 7, and engaging members 53*c* such as stepped axes and stepped screws, etc., may be inserted into the respective slits 53*b*, so that the slide shutter 53 is slidably supported at the lid 45.

An operating arm 55 having an engaging hole 55*a* is formed so as to protrude outward at the respective forward and backward end portions at the right side, as shown in FIG. 9, of the slide shutter 53. An operating member 57, such as an electromagnetic solenoid and a pneumatic cylinder, is attached to the respective forward and backward end portions, as shown in FIG. 9, of the base plate 39. An engaging portion 57*a* of each operation member 57 is engaged with the respective engaging hole 55*a*, such that the slide shutter 53 is opened and closed with respect to the lid 45 by actuation of the corresponding operating member 57.

Figure 8:
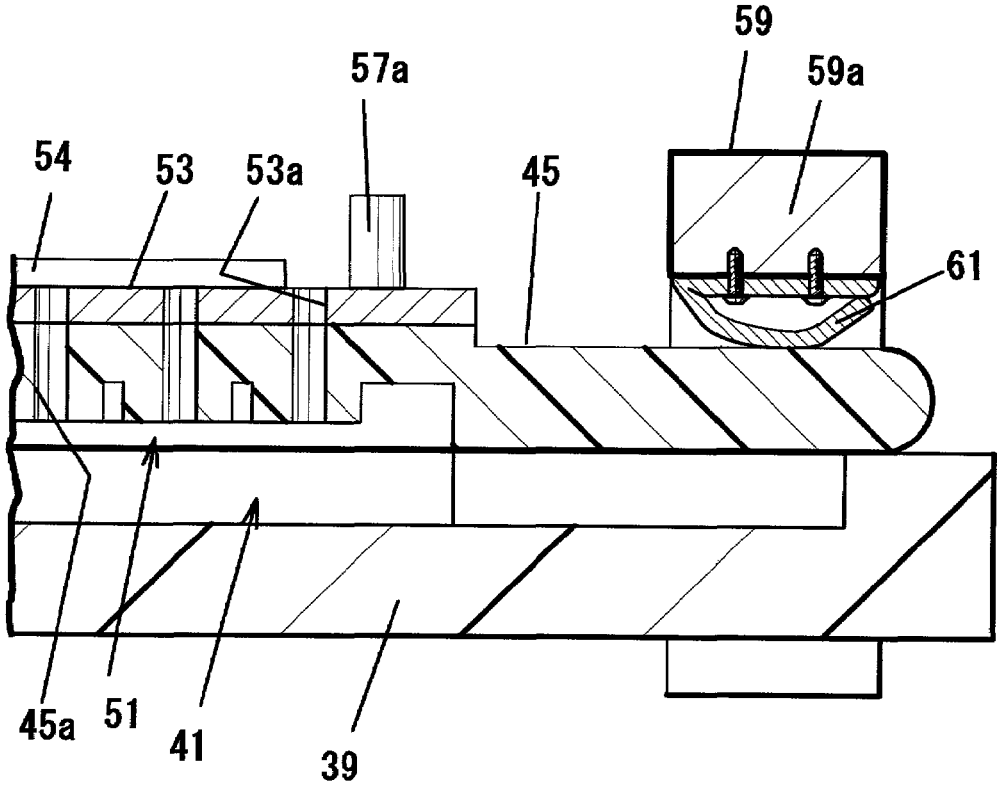
FIG. 8 is a view explaining a pressing structure effected by a locking member.
Figure 10:
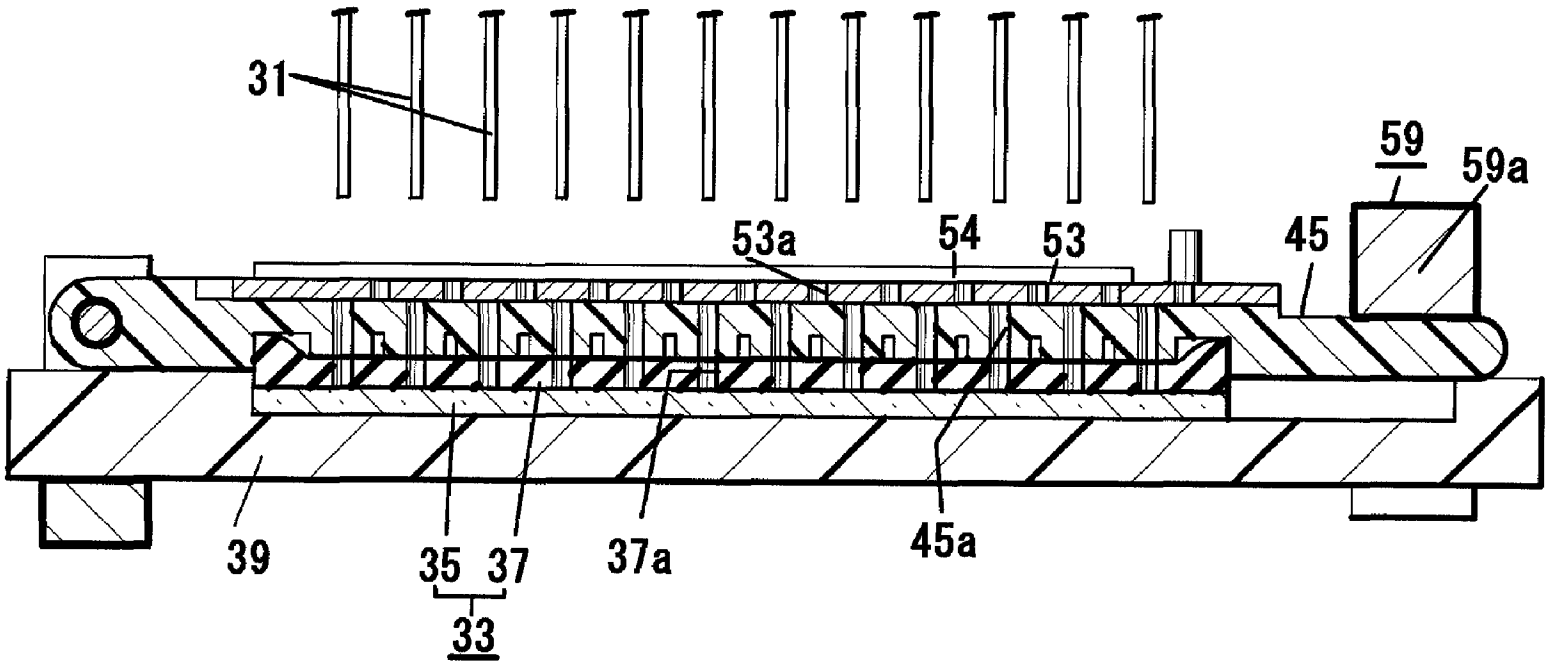
FIG. 10 is a view showing a closed state of the resilient layer retaining member.

A locking member 59 at the right side, as shown in FIG. 10, of the base plate 39 is supported so as to be turnable. The locking member 59 is composed of a locking arm portion 59*a*, which is brought into contact with the entirety of the right end portion of the lid 45, in the lengthwise direction of the lid 45, when the lid 45 turned to the position covering the upper surface of the base plate 39 and an axial supporting arm portion 59*b*, which suspends extends from both end parts of the locking arm portion 59*a* and is axially supported on the base plate 39. When the locking arm portion 59*a* is brought into contact with the upper surface at the right side end of the lid 45 and locked thereat, the axial supporting member 59 causes the respective resilient layers 37, which are held on the lid 45, to be adhered to the respective substrates 35, which are retained on the base plate 39.

Where the length of the axial supporting arm portion 59*b* is made short to cause the locking member 59 to be tightly adhered to the lid 45, maneuverability is worsened when locking and unlocking the locking arm portion 59*a*. To prevent the above from occurring, as shown in FIG. 8, a pressing member 61 such as a plate spring or a pin having a spring, etc., is provided at the locking arm portion 59*a*, and the lid 45 is pressed in the closing direction by a resilient force of the corresponding pressing member 61, wherein the adhesivity between the substrate 35 and the resilient layer 37 may be increased.

Next, a description is given of an embodiment using a protein chip holding tool 7 when producing a protein chip 33 and when analyzing a preparation to be tested, by using the produced protein chip 33.

First, a description is given of an example using the protein chip holding tool 7 when producing a protein chip 33.

Prior to producing the protein chips 33, the moving body 11 is controlled and moved in a state where the respective suction needles 13 are caused to communicate with the respective syringes 25*a* of the suction and discharge device 25 by the suction and discharge changer device 17, and a number of suction needles 13 are caused to sink into respective reservoirs of a container body in which a protein test sample solution is accumulated. After that, a piston is driven in the suction direction, wherein the protein test sample solution is sucked into the syringes 25*a* and is accumulated therein. The changer plate 21 of the suction and discharge changer device 17 is moved after the above-described suction action is carried out, wherein a flow channel is changed over so that the respective syringes 25*a* of the suction and discharge device 25 communicates with the respective distribution needles 31.

On the other hand, in a state where the lid 45 is moved and turned to an open position with respect to the base plate 39 as shown in FIG. 9, substrates 35 are set in respective downward facing recesses 41 of the base plate 39 and resilient layers 37 are set in respective upward facing recesses 51 of the lid 45. After that, the lid 45 is turned and moved to the base plate 39 side as shown in FIG. 1, and the locking member 59 is locked at the tip end portion of the lid 45.

At this time, the resilient layers 37 are resiliently deformed by locking of the locking member 59 and are brought into close contact with the substrates 35. Further, the engaging portions 57*a* of the operating members 57 are engaged in the engaging holes 55*a* in the above-described closed state. Also, as shown in FIG. 10, the slide shutter 53 is slid on the upper surface of the lid 45, such that the respective slits 53*a* are located between the holes 45*a*, and the respective holes 37*a* are closed.

Figure 11:
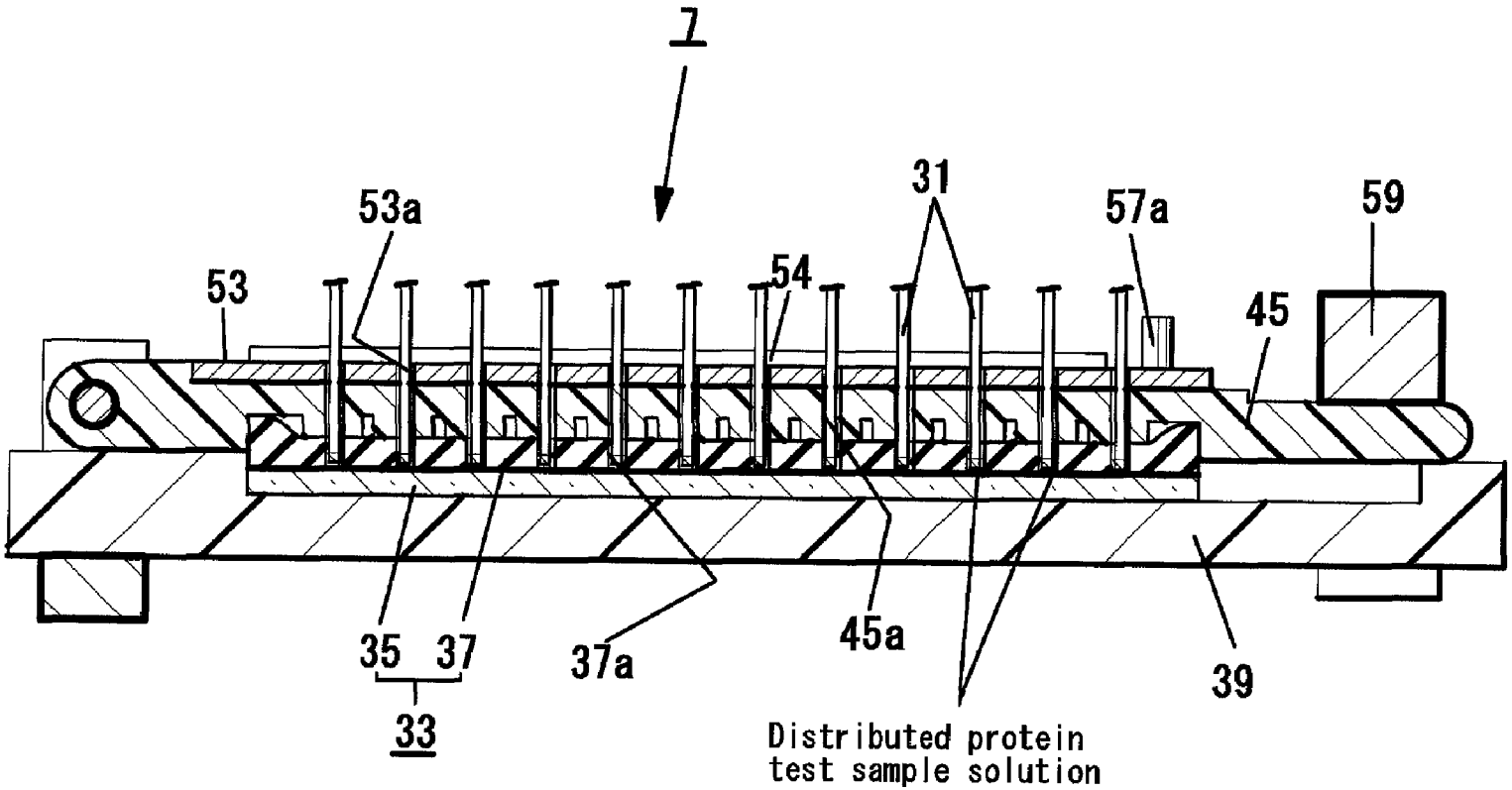
FIG. 11 is a view showing an open state of holes in the resilient layer holding member.

The slide shutter 53 is slid in the leftward direction shown in, for example, FIG. 11, by actuating the operating member 57 in the above described state, and the respective slits 53*a* are made coincident with the respective holes 45*a* of the lid 45, such that the respective holes 37*a* of the resilient layers 37 are exposed to the outside.

After, in the above-described state, the respective distribution needles 31 are caused to face the respective exposed holes 37*a* of the resilient layers 37 secured in the first row in the forward and backward direction via the slits 53*a* and holes 45*a* by controlling and moving the moving body 29, the moving body 29 is lowered, and the tip end parts of the respective distribution needles 31 are caused to advance into the respective holes 37*a*. Thereafter, the pistons in the respective syringes 25*a* are slightly moved in the micron level, whereby the protein test sample solution accumulated in the syringes 25*a* is discharged to the respective distribution needle 31 side and is dispersed into the respective holes 37*a*.

At this time, the amount of movement of the pistons in the syringes 25*a* is controlled so that the amount of protein test sample solution accumulated in the holes 37*a* becomes 0.5 through 10 μl, preferably 5 μl. Also, since the resilient layers 37 are brought into close contact with the upper surfaces of the substrates 35 at a high degree of airtightness as described above, the protein test sample solution accumulated in the holes 37*a* is prevented from leaking, whereby respective protein test sample solutions accumulated in the respective holes 37*a* are prevented from contaminating each other.

Next, the moving body 29 is moved in the forward and backward direction after the respective distribution needles 31 are removed from the holes 37*a* of the resilient layer 37 at the first row in the forward and backward direction by vertically moving the moving body 29, and the moving body 29 is caused to face the respective holes 37*a* of the resilient layer 31 at the second row in the forward and backward direction. After that, an appointed amount of protein test sample solution is distributed into the respective holes 37*a* of the resilient layer 37 at the second row in the forward and backward direction by actions similar to those described above.

By repeating the above-described actions, an appointed amount of a protein test sample solution is distributed into the holes 37*a* of the respective resilient layers 37 closely adhered to the respective substrates 35, and five protein chips 33 are produced. After that, the slide shutter 53 is moved in the rightward direction in FIG. 9 by moving the operating member 57 back, wherein the respective slits 53*a* are located between the respective holes 45*a*, and the respective holes 37*a* are closed.

Thereby, it is possible to prevent the protein of the protein test sample solutions accumulated in the respective holes 37*a* of the resilient layers 37 in the protein chips 33 from being denatured due to drying in a short time and being inactivated, whereby it is possible to produce protein chips 33 by which a reaction of a preparation to be tested in a liquid phase can be securely carried out.

Next, a description is given of a holding state of protein chips by a protein chip holding tool 7 when a reaction with the preparation to be tested is carried out.

A number of suction needles 13, a suction and discharge changer device 17, a suction and delivery device 25, distribution needles 31, which are used to produce protein chips 33, and the inside of pipes 18, 23 and 27 that connect the above components are washed prior to the distribution of a preparation to be tested, to protein test samples in the protein chips 33.

A method for washing protein test samples is such that the suction and discharge device 25 is actuated while varying respective flow lines by the suction and discharge changer device 17 in a state where collection containers (not illustrated) are respectively placed on the body frame 9 responsive to the suction and discharge device 3 and distribution device 5, and excessive protein test sample solutions in the suction needles 13, suction and discharge changer device 17, suction and discharge device 25, distribution needles 31, and pipes 18, 23 and 27, which connect the above components, are respectively discharged from the respective suction needles 13 and distribution needles 31 into the respective collection containers for collection thereof.

Next, the suction and discharge device 25 is actuated for suction in a state where the respective distribution needles 31 are immersed in a washing solution container (not illustrated) that is placed on the body frame 9 at the suction and discharge device 3 side, and the washing solution is sucked into the respective syringes 25*a*. After that, the suction and discharge device 25 is actuated for discharge in a state where the flow lines are changed by the suction and discharge changer device 17 to the suction needle 13 side and the distribution needle 31 side in order, wherein work of discharging the accumulated washing solution from the respective suction needles 13 or distribution needles 31 into the collection containers is repeated several times, thereby washing the protein test sample solution.

A washing solution used for the above-described washing contains a 0.005 through 0.1% Tween 20 water solution, ultra-pure water, and PBS. The protein test sample solutions are washed off by using the above-described 0.005 through 0.1% Tween 20 water solution, ultra-pure water, and PBS in order. After that, the pistons of the respective syringes 25*a* of the suction and discharge device 25 are actuated for operation to discharge internal air contained in the respective suction needles 13 and distribution needles 31 therefrom, wherein these suction needles 13, suction and discharge changer device 17 and distribution needles 31, and the inside of pipes 18, 23 and 27 that connect the above-described components are dried.

After the above-described washing treatment is completed, a container body in which a preparation solution to be tested, and which will be analyzed, is accumulated in its respective reservoirs, is set on the body frame 9 at the suction and discharge device 3 side. After that, the moving body 11 is controlled and moved as in the case where the protein chips 33 are produced, the respective pistons of the suction and discharge device 25 are actuated for suction after the respective suction needles 13 are immersed in the respective reservoirs of the container body in which a preparation solution to be tested is accumulated, whereby the preparation solution is sucked into syringes 25*a* and accumulated therein.

After the above-described sucking operation is completed, the changer board 21 of the suction and discharge changer device 17 is moved and the flow line is changed so that the respective syringes 25*a* of the suction and discharge device 25 are able to communicate with the respective distribution needles 31. After that, the moving body 29 is controlled and moved, whereby the respective distribution needles 31 are respectively faced to the respective holes 37*a* of the resilient layers 37 at the protein chips 33 that are held by the protein chip holding tool 7, for example, at the first row in the forward and backward direction.

At this time, the slide shutter 53 is moved by operating the operating member 57 to cause the holes 37*a* of the resilient layers 37 of the respectively produced protein chips 33 to be exposed to the outside.

Next, after the moving body 29 is moved downward in the above-described state, and the respective distribution needles 31 are caused to advance into the respective holes 37*a*, the respective pistons of the suction and discharge device 25 are moved by an appointed distance in the discharge direction, and the preparation solution to be tested, which is accumulated in syringes 25*a*, is discharged by an appointed amount.

After, by repeating the above-described action, the preparation solution to be tested is discharged, at an appointed ratio of amount, into the holes 37*a* of the resilient layers 37 at the respective protein chips 33 that are set on the protein chip holding tool 7, the operating member 57 is moved back in order to slide the slide shutter 53 into the closing direction, wherein the respective holes 37*a* of the resilient layers 37 are closed, and the protein test samples, which are in the holes 37*a* of the respective resilient layers 37, and a preparation solution to be tested, are reacted in the liquid phase in the above-described state.

In the above described reaction, since the respective holes 37*a* of the resilient layers 37 are interrupted by the atmosphere by the slide shutter 53, the protein test sample solutions, which are accumulated in the respective holes 37*a*, and the preparation solutions are prevented from being dried, wherein it is possible to securely carry out a liquid phase reaction.

The protein chip holding tool 7 has the following actions and effects.

1. By operating to close the lid 45, in which the resilient layers 37 are set, with respect to the base plate 39 on which the substrates 35 are set, it is possible to bring the resilient layers 37 and the substrates 35 into close contact with each other. At this time, the adhesivity of both can be increased by resiliently deforming the resilient layers 37 with respect to the substrates 35, wherein it is possible to prevent the protein test sample solutions distributed in respective holes 37*a* of the resilient layers 37 and a preparation solution to be tested from leaking, and it is possible to prevent both of the solutions from contaminating each other.
2. Since the matching planes of the resilient layers 37 and the substrates 35 are polished and flattened at a high degree of accuracy, the adhesivity of both can be increased, and it is possible to prevent the protein test sample solutions distributed in respective holes 37*a* and a preparation solution to be tested from leaking, and it is possible to prevent both of the solutions from contaminating each other.
3. By sliding the slide shutter 53 to expose the respective holes 37*a* of the resilient layers 37 when producing protein chips and analyzing a preparation to be tested by the produced protein chips, it becomes possible to distribute the protein test sample solutions and preparation solution to be tested, and it is possible to prevent the protein test samples and preparation solution to be tested from being denatured or inactivated due to drying of the distributed protein test samples and the preparation solution, which is added thereto, by closing the holes 37*a* of the resilient layers 37 by causing the sliding shutter 53 to slide after the protein chips are produced or when executing a reaction. That is, analysis of the preparation solutions to be tested can be effectively carried out.
4. Since the lid 45 is pressed to the base plate 39 side by the pressing member 61 of the locking member 59 and the resilient layers 37 are brought into close contact with the substrates 35 at a high degree of airtightness, it is possible to prevent protein test sample solutions, which are distributed into the respective holes 37*a*, and a preparation solution to be tested from leaking, and it is also possible to prevent the solutions from contaminating each other.

The present invention may be carried out in the following modified versions.

1. Although, in the above description a structure is described in which five substrates 35 are set on a single base plate 39, a plurality of lines of substrates, each line consisting of five substrates, may be set In this case, a lid may be provided with slide shutter secured per line, and a locking member 59.
2. Although, in the above description a structure is described in which a number of holes 45*a* coincident with the number of holes 37*a* of the held resilient layers 37 are provided in the lid 45, a plurality of slits having a length coincident with the entirety of a plurality of holes 37*a* in the row direction of a resilient layer 37 may be employed. Also, slits 53*a* of the slide shutter 53 may be made into holes coincident with the number of holes 37*a* of the resilient layers 37.
3. Although, in the above description, the slide shutter 53 is selectively slid by the operating member 57 and the holes 37*a* of the resilient layers 37 are opened and closed, the operating member 57 is not necessarily requisite in the composition of the present invention. Instead, an operator may manually slide the slide shutter 53.
4. Although, in the above description a structure is described in which the slide shutter 53 is opened and closed by normal and reverse operations of the operating member 57, another structure may be employed, in which a tension spring or a compression spring is provided at the lid 45 and the slide shutter 53. In this case, the slide shutter 53 is slid in the opening direction by the operating member to open the holes 37*a* while the slide shutter 53 is always urged to slide in the closing direction by a resilient force of these spring members with respect to the lid 45.

What is claimed is:

1. A protein chip holding tool for holding at least one protein chip, said at least one protein chip including a resilient layer which has a number of holes arranged in a matrix therein and which is closely adhered onto an upper surface of a substrate, each of said holes being adapted to hold a predetermined amount of a protein test sample solution therein, said protein chip holding tool comprising:

a base plate including at least one substrate holding portion which holds the substrate and which is provided in an upper surface of the base plate;

a lid rotatably supported at one end portion of the base plate so as to be rotatable to cover the upper surface of the base plate, said lid including: (i) at least one resilient layer holding portion which holds the resilient layer, and which is provided in a surface of the lid that faces the base plate when the lid is turned to cover the base plate, at a position corresponding to the substrate holding portion in the surface of the base plate, and (ii) a plurality of openings which extend through the lid to expose the holes in the resilient layer held in the resilient layer holding portion; and a slide shutter which is slidably supported on an upper surface of the lid, and which comprises a plurality of slits extending therethrough which are spaced apart at a pitch equal to a pitch of the openings in the lid along a sliding direction of the slide shutter;

wherein the slide shutter is slidable to open and close the openings in the lid by aligning the slits in the slide shutter with the openings in the lid and by removing the slits from alignment with the openings in the lid.

2. The protein chip holding tool as set forth in claim 1, wherein the resilient layer comprises a silicone rubber plate, and a plane of the resilient layer which faces the substrate is ground and flattened.

3. The protein chip holding tool as set forth in claim 1, wherein the openings in the lid correspond respectively to the holes in the resilient layer.

4. The protein chip holding tool as set forth in claim 1, wherein the openings in the lid comprise slits that each expose a plurality of the holes in the resilient body.

5. The protein chip holding tool as set forth in claim 1, further comprising an operating member which is operable to slide the slide shutter to open and close the openings in the lid, and wherein when the lid is turned to cover the base plate, the slide shutter is coupled to the operating member to slide the slide shutter to open and close the openings in the lid.

* * * * *